United States Patent [19]

van Lent

[11] 4,127,791

[45] Nov. 28, 1978

[54] CATHODE RAY TUBE SHADOW MASK WITH SLOTTED APERTURES

[75] Inventor: Johannes G. van Lent, Eindhoven, Netherlands

[73] Assignee: U.S. Philips Corporation, New York, N.Y.

[21] Appl. No.: 743,535

[22] Filed: Nov. 22, 1976

[30] Foreign Application Priority Data

Dec. 18, 1975 [NL] Netherlands ..... 7514744

[51] Int. Cl.[2] ..... H01J 29/07

[52] U.S. Cl. ..... 313/403

[58] Field of Search ..... 313/403, 408

[56] References Cited

U.S. PATENT DOCUMENTS

| | | | |
|---|---|---|---|
| 3,652,895 | 3/1972 | Tsuneta et al. | 313/403 |
| 3,663,854 | 5/1972 | Tsuneta et al. | 313/403 |

*Primary Examiner*—Robert Segal

*Attorney, Agent, or Firm*—Algy Tamoshunas

[57] ABSTRACT

A cathode ray tube for displaying colored pictures of the shadow mask type. The shadow mask has rows of elongate apertures separated by bridges. By causing the vertical pitch, that is the distance between the centers of two successive apertures in a row, to vary in a given manner, substantially no irregularities in the applied phosphor lines occur any longer during the manufacture of the display screen.

1 Claim, 3 Drawing Figures

Figure 3:
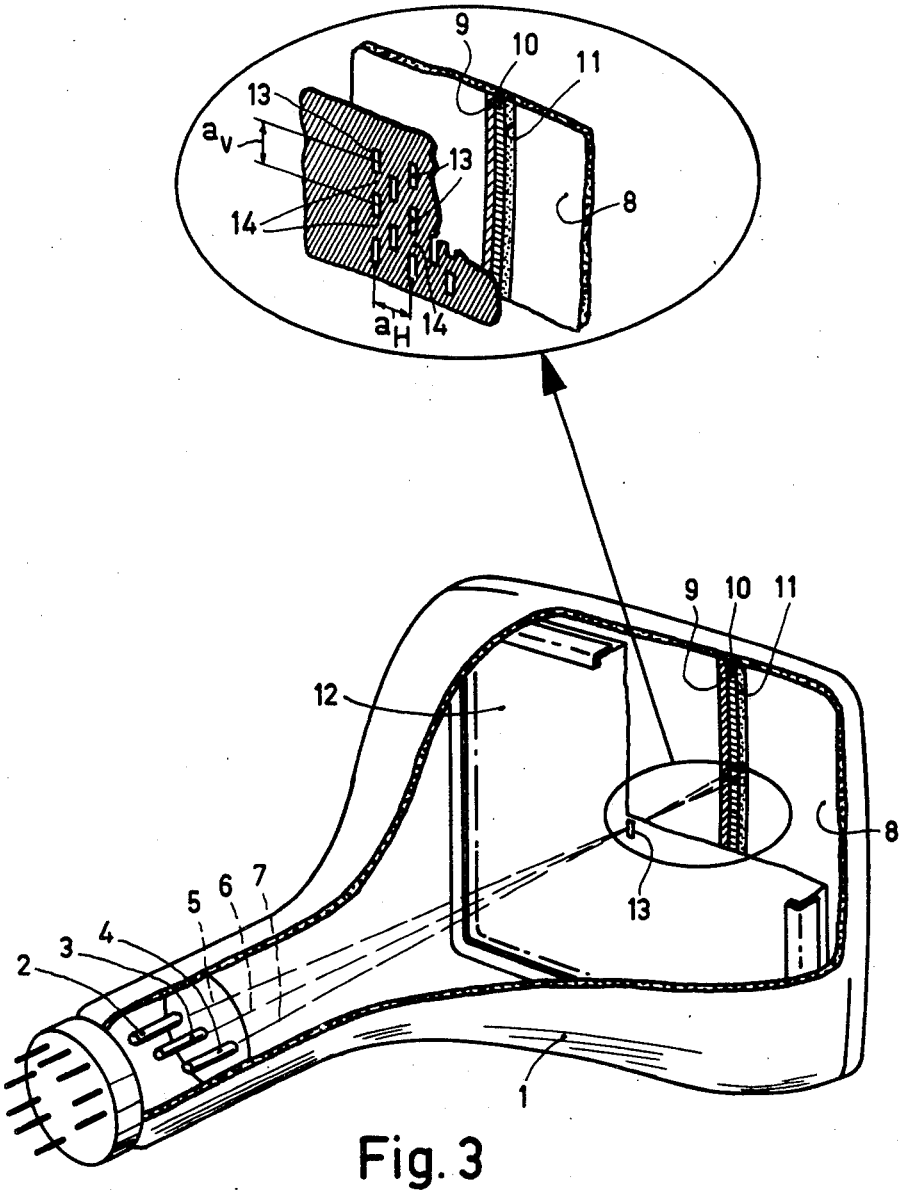

| | | | | |
|---|---|---|---|---|
| 0,765 | 0,719 | 0,704 | 0,719 | 0,765 |
| 0,815 | 0,769 | 0,754 | 0,769 | 0,815 |
| 0,831 | 0,785 | 0,770 | 0,785 | 0,831 |
| 0,815 | 0,769 | 0,754 | 0,769 | 0,815 |
| 0,765 | 0,719 | 0,704 | 0,719 | 0,765 |

12

Fig. 1

| | | | | |
|---|---|---|---|---|
| 0,726 | 0,703 | 0,695 | 0,703 | 0,726 |
| 0,775 | 0,752 | 0,744 | 0,752 | 0,775 |
| 0,791 | 0,768 | 0,760 | 0,768 | 0,791 |
| 0,775 | 0,752 | 0,744 | 0,752 | 0,775 |
| 0,726 | 0,703 | 0,695 | 0,703 | 0,726 |

12

Fig. 2

CATHODE RAY TUBE SHADOW MASK WITH SLOTTED APERTURES

The invention relates to a cathode ray tube for displaying coloured pictures and comprising in an evacuated envelope a display screen on a wall part of the envelope which forms the display window, which display screen comprises stripe-shaped luminescent regions, in front of which display screen a colour selection electrode (sometimes termed shadow mask or mask) is arranged which has a metal plate which is provided with rows of slot-like apertures separated from each other by bridges and extend parallel to the stripe-shaped regions.

Such a cathode ray tube is known inter alia from German Patent Application No. 2,405,979 laid open to public inspection in which is described a method of manufacturing such tubes, in particular the display screen. During the manufacture of the display screen, a photo-sensitive phosphor-containing layer is provided on the display window a few times in succession (usually 3x), which layer is then exposed via the slot-shaped apertures in the colour selection electrode and is then fixed, as a result of which the stripe-shaped luminescent regions are formed on the display window. The exposure is carried out by means of an elongate light source the longitudinal axis of which extends in the direction of the rows of apertures. Said elongate light source should have such a length that the light distribution behind the rows of apertures which are separated by bridges has a variation which is as honogeneous as possible so that stripe-shaped luminescent regions which have the same width substantially everywhere and which form the display screen are obtained. It is therefore suggested in the said German Patent Application No. 2,405,979 laid open to public inspection to reciprocate a punctiform light source over such a distance that an elongate light source having a length $l$ which is the average of $l_0$ and $l_1$, being the minimum and the maximum light source length, respectively, necessary for exposing several places on the display screen is formed.

It has been found that when a light source having such an average length $l$ is used, it is nevertheless still too long or too short for certain parts of the display screen. The result of this is that at said areas small widenings and constrictions, respectively, of the stripe-shaped luminescent regions will occur. Although said widenings and constrictions are smaller than those which would occur when a light source having an arbitrary length is used, they are nevertheless so large that they adversely influence the picture quality (colour purity) of the manufactured cathode ray tube. The cause of this is stated in the said German Patent Application No. 2,405,979, namely the fact that a) the distance L of the deflection surface (and light source) to a point on the display screen and b) the distance $q$ along the electron path of the colour selection electrode to the display screen are not constant, so that the ratio $q/L$ varies. Moreover, the fact that the display screen is convex plays a part.

It is the object of the invention to provide measures which also tend to reduce the occurence of small constrictions and widenings of the stripe-shaped regions so that a cathode ray tube having a greater colour purity is obtained.

According to the invention, a cathode ray tube of the kind mentioned in the first paragraph is characterized in that the distance $a_v$ between the centres of two successive apertures of a row, the so-called vertical pitch, is expressed by the relationship:

$$a_v = C_1 (1 + C_2 (x^2 - y^2)) \quad (1)$$

wherein $x$ and $y$ are the coordinates on the colour selection electrode and at right angles to and parallel to the rows of apertures, respectively, and $$C_1 = a_{vo} \frac{S_O}{S} + \frac{a_H}{a_{HO}},$$

$a_{vo}$ is the vertical pitch in the centre of the colour selection electrode,..

$S_0$ is the eccentricity of the electron beams in the deflection plane in front of the centre of the tube, $S$ is the eccentricity of the electron beams in the deflection plane for a given place $x$ and $y$ in the tube, $a_{HO}$ is the horizontal pitch in the centre of the colour selection electrode, and $a_H$ is the horizontal pitch associated with $x$ and $y$ or the distance between two successive rows, and $C_2 = 1/RL_0$, wherein $R$ is the radius of the part of the display screen associated with $x$ and $y$, and $L_0$ is the distance from the deflection plane to the centre of the display screen.

According to the above-mentioned German Patent Application the desired length of the light source is determined by the relationship $$l = a_v L/q, \quad (2)$$

wherein $a_v$ is the vertical pitch $q$ is the distance along the electron path between the colour selection electrode and the display screen, and $L$ is the distance from the light source to a point on the display screen.

According to the invention, with a light source having a fixed length $l$ (the average between $l_1$ and $l_0$) which is influenced only by the correction lens which is usual upon exposure and with a variable $q/L$, constrictions and widenings of the luminescent stripes can be prevented by adapting $a_v$, the vertical pitch.

From the following calculations it follows that said variation in the pitch is expressed by relationship (1) above. The condition which must be satisfied in order that the light distribution behind a vertical row of mask slots be homogeneous, reads:

$$l' = a'_v \quad (3)$$

wherein $l'$ is the reproduction of the elongate light source through a mask slot on the screen and $a'$ is the projection of the mask pitch on the screen. For the projection of the mask pitch it holds that:

$$a'_v = a_x \frac{L}{L - q} \quad (4)$$

For a flat screen it holds that:

$$l' = \frac{lq}{L - q} \tag{5}$$

Substitution of (4) and (5) in (3) gives the relationship (2). So this relationship holds for a flat screen.

However, the display screen of a television picture tube is not flat but to a first approximation is a part of a spherical surface. In the reproduction of the elongate light source $l$ on the display screen the fact should therefore be taken into account that the radial dimensions are reduced by a factor K, the so-called radial compression factor.

$l'$ is the reproduction of the light source on a flat screen. Due to the compression the radial component $l' \cos \psi$ is reduced to $K\, l' \cos \psi$. By composing said compressed component again with the unvaried tangential component $l' \sin \psi$ it follows that:

$$l = l' (K^2 \cos^2 \psi + \sin^2 \psi)^{\frac{1}{2}}$$

Following from (5) it thus holds for a sphere that $$l' = \frac{lq}{L - q} (K^2 \cos^2 \psi + \sin^2 \psi)^{\frac{1}{2}} \tag{6}$$

Substitution of (4) and (6) in (3) gives $$a_v = l \frac{q}{L} (K^2 \cos^2 \psi + \sin^2 \psi)^{\frac{1}{2}} \tag{7}$$

This relationship gives the condition which must be satisfied if phosphor lines are to be obtained without constrictions and/or widenings. Hereinafter, the relationship (7) is reduced to a form in which the vertical mask pitch is given as a function of the place on the mask.

In the centre of the tube the following relationships apply:

$$a_{vo} = l\, q_O / L_O \tag{8}$$

and $$q_O = \frac{a_{HO} L_O}{3 S_O} \tag{9}$$

From the relationships (7), (8) and (9), $l$, $q_o$ and $L_o$ may be eliminated:

$$a_v = a_{vo} \frac{3 S_O}{a_{HO}} \frac{q}{L} (K^2 \cos^2 \psi + \sin^2 \psi)^{\frac{1}{2}} \tag{10}$$

The distance $q$ between mask and display screen can readily be described outside the centre of the mask by $$q = \frac{a_H L}{3S} \left( \frac{\sin^2 \psi}{K} + \cos^2 \psi \right) \tag{11}$$

Substitution of (11) in (10) gives $$a_v = a_{vo} \frac{S_O}{S} \frac{a_H}{a_{HO}} \left( \frac{\sin^2 \psi}{K} + \cos^2 \psi \right) (K^2 \cos^2 \psi + \sin^2 \psi)^{\frac{1}{2}} \tag{12}$$

The compression factor K is given by $$K = \frac{\cos \psi}{\cos(\phi - \beta)} \tag{13}$$

wherein $\zeta$ is the deflection angle and $\beta$ is the angle between the normal on the screen and the tube axis. By expressing $\zeta$ and $\beta$ in $x$, $y$, R and $L_0$, it may be written to an approximation for (13) that $$L = \frac{RL_O - \frac{1}{2}(x^2 - y^2)}{RL_O + \frac{1}{2}(x^2 + y^2)} \tag{14}$$

Substitution of (14) in (12), in which $\psi = \arctan x/y$ is also introduced, after a few reductions gives the following relationship $$a_v = a_{vo} \frac{S_O}{S} \frac{a_H}{a_{HO}} \cdot \frac{\frac{1 + x^2 - y^2}{2RL_O}}{1 - \left(\frac{x^2 + y^2}{2RL_O}\right)} \left(1 + \frac{x^2 - y^2}{RL_O} + \left(\frac{x^2 + y^2}{2RL_O}\right)^2\right)^{\frac{1}{2}} \tag{15}$$

The term $$\left(\frac{x^2 + y^2}{2RL_O}\right)^2$$

is maximum 0.03 and thus is negligible with respect to 1, this gives:

$$a_v = a_{vo} \frac{S_O}{S} \frac{a_H}{a_{HO}} \left(1 + \frac{x^2 - y^2}{2RL_O}\right) \left(1 + \frac{x^2 - y^2}{RL_O}\right)^{\frac{1}{2}} \tag{15a}$$

In addition the root form may be replaced by $$1 + \frac{x^2 - y^2}{2RL_O},$$

so that $$a_v - a_{vo} \frac{S_O}{S} \frac{a_H}{a_{HO}} \left(1 + \frac{x^2 - y^2}{2RL_O}\right)^2 \tag{15b}$$

In processing the square, finally the term $$\left(\frac{x^2 - y^2}{2RL_O}\right)^2$$

may be neglected, so that:

$$a_v = a_{vo} \frac{S_O}{S} \frac{a_H}{a_{HO}} \left(1 + \frac{x^2 - y^2}{RL_O}\right) \tag{16}$$

Assuming that:

$$a_{vo} \frac{S_O}{S} \frac{a_H}{a_{HO}} = C_1 \tag{17}$$

and $$\frac{1}{RL_O} = C_2 \tag{18}$$

then (16) becomes:

$$a_v = C_1 (1 + C_2 (x^2 - y^2)) \tag{1}$$

wherein $C_2$ is a constant which depends only on the tube size, while $C_1$ is no constant but a function of the place on the display screen.

In tubes having a constant horizontal pitch it holds that $$C_1 = a_{vo} S_0/S$$

wherein $C_1$ is a function of $S$ and is determined by the deflection system.

Although the pitch variation according to (1) proves to be a very good approximation of the pitch variation according to (7), it will in practice be better, in connection with the capability of manufacturing such a mask, to replace the relationship (1) by $$a_v = K_1 (1 + K_2 x^2 - K_3 y^2) \quad (19)$$

wherein the constants $K_1$, $K_2$ and $K_3$ may be chosen to be so that the constrictions and widenings of the phosphor lines are minimum in particular in the critical areas. In addition, disturbances caused by the correction lens and left out of consideration in the reduction may be discounted.

Embodiments of the invention will now be described by way of example with reference to the diagrammatic drawings in which FIG. 1 shows diagrammatically a colour selection electrode for a 26 inch tube having a vertically extending pitch FIG. 2 shows diagrammatically a colour selection electrode for an 18 inch tube having a vertically extending pitch, and FIG. 3 shows a cathode ray tube.

FIG. 1 shows diagrammatically a colour selection electrode 12 for a 26 inch tube. The values of the vertical pitch at a number of positions on the colour selection electrode are given in mm. It furthermore holds for such a tube, for example:

$a_{vo} = 0.770$ mm
$S_0 = 8.1$ mm
$R = 1000$ mm
$L_0 = 270$ mm
$q_0 = 8.56$ mm

The same is done in FIG. 2 for an 18 inch tube having dimensions:

$a_{vo} = 0.760$ mm
$S_0 = 7.09$ mm
$R = 711$ mm
$L_0 = 193$ mm
$q_0 = 6.08$ mm

FIG. 3 shows a cathode ray tube embodying the invention. Situated in a glass envelope 1 are means 2, 3 and 4 for generating three electron beams 5, 6 and 7 which impinge upon the display screen 8 through apertures 13 in a colour selection electrode 12. The three electron beams 5, 6 and 7 make such an angle with each other, the so-called colour selection angle, that they each impinge upon a luminescent line of one colour 11, 10 and 9, respectively. The apertures in the colour selection electrode 12 are separated by bridges 14. By using an elongate light source of a length as described above when producing the luminescent lines by means of a photographic process, luminescent lines are obtained having a substantially constant width. Nevertheless, small widenings and constrictions of the lines 9, 10 and 11 occur behind the bridges 14. This is caused by the fact that the light source used is too long for certain parts of the display screen and is too short for other parts. This can be prevented by adapting the vertical pitch $a_v$ of the colour selection electrode 12 according to formula (1). It will be obvious that anyone who manufactures a cathode ray tube having a colour selection electrode in which the pitch extends approximately according to formula 1 and $C_1$ and $C_2$ are the values belonging the said cathode ray tube, uses the invention.

What is claimed is:

1. In a cathode ray tube for displaying coloured pictures and comprising an evacuated envelope, a display screen on a wall part of the envelope and forming the display window, said display screen comprising stripe-shaped luminescent regions, a colour selection in front of said display screen and comprising a metal plate, said plate having rows of slot-like apertures separated from each other by bridges and extending parallel to the stripe-shaped regions; the improvement wherein the vertical pitches distance $a_v$ between the centers of the successive apertures of a row have values according to the formula $$a_v = C_1 (1 + C_2(x^2 - y^2))$$

wherein $x$ and $y$ are the coordinates on said colour selection electrode at right angles to and parallel to the rows of apertures, respectively, and $C_1$ and $C_2$ are determined as $$C_1 = a_{vo} \frac{S_O}{S} + \frac{a_H}{a_{HO}},$$

wherein $a_{vo}$ is the vertical pitch in the center of the colour selection electrode, $S_0$ is the eccentricity of the electron beams in the deflection plane in front of the center of the tube, $S$ is the eccentricity of the electron beams in the deflection plane for a given place $x$ and $y$ in the tube, $a_{HO}$ is the horizontal pitch in the center of the colour selection electrode, and $a_H$ is the horizontal pitch associated with $x$ and $y$ or the distance between two successive rows, and $C_2 = 1/RL_0$, wherein $R$ is the radius of the part of the display screen associated with $x$ and $y$, and $L_0$ is the distance from the deflection plane to the center of the display screen.

* * * * *

UNITED STATES PATENT OFFICE

CERTIFICATE OF CORRECTION

Patent No. 4,127,791 Dated November 28, 1978

Inventor(s) JOHANNES G. VAN LENT

It is certified that error appears in the above-identified patent and that said Letters Patent are hereby corrected as shown below:

In the Claim:

Claim 1, line 23, after "colour selection" insert --electrode--

Signed and Sealed this

First Day of May 1979

[SEAL]

Attest:

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. 4,127,791

DATED November 28, 1978

INVENTOR(S) : Johannes G. Van Lent

It is certified that error appears in the above-identified patent and that said Letters Patent are hereby corrected as shown below:

In the Claim:

Claim 1, line 40, delete "+".

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,127,791

DATED : Nov. 28, 1978

INVENTOR(S) : JOHANNES G. VAN LENT

It is certified that error appears in the above-identified patent and that said Letters Patent are hereby corrected as shown below:

Col. 2, line 13, delete "+" in equation for "$C_1$".

Fig. 3 of the drawings, - change the reference character "$a_H$" to indicate the distance between adjacent vertical rows of apertures.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*